US009202445B2

(12) United States Patent
Um et al.

(10) Patent No.: US 9,202,445 B2
(45) Date of Patent: Dec. 1, 2015

(54) DISPLAY DRIVE INTEGRATED CIRCUIT

(75) Inventors: Pan-Wook Um, Hwaseong-si (KR); Hae-Woon Park, Hwaseong-si (KR); Dong-Hoon Yang, Seoul (KR)

(73) Assignee: SAMSUNG ELECTRONICS CO., LTD., Suwon-Si, Gyeonggi-Do (KR)

( * ) Notice: Subject to any disclaimer, the term of this patent is extended or adjusted under 35 U.S.C. 154(b) by 714 days.

(21) Appl. No.: 13/614,014

(22) Filed: Sep. 13, 2012

(65) Prior Publication Data

US 2013/0194243 A1 Aug. 1, 2013

(30) Foreign Application Priority Data

Jan. 27, 2012 (KR) ..... 10-2012-0008139

(51) Int. Cl.

| | |
|---|---|
| ***G09G 5/393*** | (2006.01) |
| ***G09G 5/397*** | (2006.01) |
| *G09G 3/00* | (2006.01) |

(52) U.S. Cl.

CPC ..... *G09G 5/393* (2013.01); *G09G 5/397* (2013.01); *G09G 3/003* (2013.01); *G09G 2320/103* (2013.01); *G09G 2340/16* (2013.01); *G09G 2360/12* (2013.01)

(58) Field of Classification Search

CPC ..... G09G 5/393

See application file for complete search history.

(56) References Cited

U.S. PATENT DOCUMENTS

| | | | | |
|---|---|---|---|---|
| 5,546,104 | A | 8/1996 | Kuga | |
| 5,787,199 | A * | 7/1998 | Lee | 382/203 |
| 7,362,295 | B2 | 4/2008 | Park et al. | |
| 7,385,634 | B2 | 6/2008 | Nakashita | |
| 7,734,108 | B2 | 6/2010 | Oura | |
| 2011/0169845 | A1 * | 7/2011 | Sreenivas et al. | 345/536 |
| 2012/0008002 | A1 * | 1/2012 | Bigioi et al. | 348/222.1 |
| 2013/0136177 | A1 * | 5/2013 | Tajime et al. | 375/240.12 |

FOREIGN PATENT DOCUMENTS

| | | |
|---|---|---|
| JP | 07-152340 | 6/1995 |
| KR | 100155910 | 7/1998 |
| KR | 1019990041581 | 6/1999 |
| KR | 1020090006997 | 1/2009 |

* cited by examiner

*Primary Examiner* — Jason Olson

(74) *Attorney, Agent, or Firm* — F. Chau & Associate, LLC

(57) ABSTRACT

A display drive integrated circuit includes a single full frame memory having a first half frame memory region and a second half frame memory region, a mode determination unit and a control unit. The mode determination unit determines the received image data type (still image or video) and accordingly selects a normal mode or an enhance mode associated with a display quality. The control unit operates in the normal mode or the enhance mode in response to an output of the mode determination unit. In an enhance mode, the control unit divides the single full frame memory into a first half frame memory region and a second half frame memory region to store compressed image data of a current frame in the first half frame memory region and compressed image data of a previous frame in the second half frame memory region.

20 Claims, 10 Drawing Sheets

DISPLAY DRIVE INTEGRATED CIRCUIT

CROSS-REFERENCE TO RELATED APPLICATION

This application claims priority under 35 USC §119 to Korean Patent Application No. 10-2012-0008139, filed on Jan. 27, 2012, in the Korean Intellectual Property Office (KIPO), the contents of which are herein incorporated by reference in their entirety.

BACKGROUND

1. Technical Field

Exemplary embodiments relate generally to a semiconductor integrated circuit, and more particularly to a display drive integrated circuit (DDI) adaptable to a mobile device to enhance the quality of a displayed image.

2. Description of the Related Art

Mobile phones are currently designed to support high-resolution displays and due to the market expansion of smart phones, the development of mobile phones is focused on improvement of display quality, and of the quality of a displayed image. Various algorithms and intellectual properties (IPs) for semiconductor circuit design are being developed and the developments may be implemented through a display drive integrated circuit (DDI).

For example, as one of methods for improving the display quality, the DDI may be configured to process image data of a present (then-current) frame by referring to image data of a previous frame to provide processed image data having an enhanced display quality. To perform such a process, an additional frame memory is required to store the image data of the previous frame as well as a full frame memory to store the image data of the current frame. Chip size and power consumption of the DDI may be increased due to the additional frame memory. The increase of the DDI chip size may decrease design margin and battery life time of the mobile device including the DDI chip. Such additional circuits may also increase production cost.

SUMMARY

An aspect of the inventive concept provides a display drive integrated circuit (DDI), capable of performing image data processes using a single full frame memory without an additional frame memory and capable of determining the display quality modes autonomously.

According to exemplary embodiments, a display drive integrated circuit includes a single full frame memory, a mode determination unit and a control unit. The mode determination unit determines a normal mode or an enhance mode associated with the display quality. The control unit operates in the normal mode or the enhance mode in response to an output of the mode determination unit. In the normal mode, the control unit stores non-compressed full frame image data in the single full frame memory. In the enhance mode, the control unit divides the single full frame memory into a first half frame memory region and a second half frame memory region to store compressed image data of the current frame in the first half frame memory region and compressed image data of a previous frame in the second half frame memory region.

According to exemplary embodiments, the control unit includes a first encoder, a first decoder, a second encoder and a second decoder. The first encoder compresses first full frame image data of the current frame to output first half frame image data to be stored in the first half frame memory region. The first decoder decompresses the first half frame image data read from the first half frame memory region to output the first full frame image data of the current frame. The second encoder compresses second full frame image data of the previous frame to output second half frame image data to be stored in the second half frame memory region. The second decoder decompresses the second half frame image data read from the second half frame memory region to output the second full frame image data of the previous frame.

In the normal mode, the control unit reads the non-compressed full frame image data from the single full frame memory to output the non-compressed full frame image data without performing a display quality enhancing process. In the enhance mode, the control unit reads first half frame image data from the first half frame memory region and second half frame image data from the second half frame memory region, performs the display quality enhancing process based on the first and second half frame image data to output enhanced image data, and compresses the enhanced image data to third half frame image data to store the third half frame image data in the second half frame memory region.

In an enhance starting mode, the control unit compresses full frame image data of the current frame to half frame image data to store the half frame image data in the first and second half frame memory regions, respectively, read the half frame image data from the first half frame memory region, and decompresses the read half frame image data to the full frame image data to output the full frame image data. In an enhance ending mode, the control unit reads the half frame image data from the first half frame memory region, and decompresses the read half frame image data to the full frame image data to output the full frame image data.

The mode determination unit includes a first counter, a second counter and a signal generator. The first counter periodically counts the number of frames up to M frames based on a vertical synchronization signal, where M is a positive integer. The second counter periodically counts the number of memory write commands during the M frames. The signal generator generates a mode signal indicating the normal mode when the number of memory write commands during the M frames is less than a reference number and the enhance mode when the number of memory write commands during the M frames is equal to or greater than the reference number.

The second counter may be reset in response to a tearing effect control signal while the first counter outputs a counted number of M.

M may be six and the reference number may be four.

The mode determination unit may alternatively determine the normal mode or the enhance mode based on a mode control signal from an external host.

The mode determination unit preferably measures the update speed of image data to be stored in the full frame memory and generates a mode signal indicating the normal mode when the update speed corresponds to a still image speed and the enhance mode when the update speed corresponds to a moving image speed.

According to exemplary embodiments, a display drive integrated circuit includes a single full frame memory, a mode determination unit and a control unit. The mode determination unit determines a normal mode or an enhance mode associated with a display quality by measuring the update speed of image data to be stored in the full frame memory. The control unit operates in the normal mode or the enhance mode in response to an output of the mode determination unit and functionally divides the single full frame memory into a first half frame memory region and a second half frame memory region in the enhance mode.

In the normal mode, the control unit stores non-compressed full frame image data in the single full frame memory and reads the non-compressed full frame image data from the single full frame memory to output the non-compressed full frame image data as still image display data without performing a display quality enhancing process. In the enhance mode, the control unit stores compressed image data of a current frame in the first half frame memory region and stores compressed image data of a previous frame in the second half frame memory region, reads first half frame image data from the first half frame memory region and second half frame image data from the second half frame memory region, performs the display quality enhancing process based on the first and second half frame image data to output enhanced image data as moving image display data, and compresses the enhanced image data to third half frame image data to store the third half frame image data in the second half frame memory region.

The control unit may include a first encoder configured to compress first full frame image data of the current frame to output first half frame image data to be stored in the first half frame memory region, a first decoder configured to decompress the first half frame image data read from the first half frame memory region to output the first full frame image data of the current frame, a second encoder configured to compress second Pall frame image data of the previous frame to output second half frame image data to be stored in the second half frame memory region, and a second decoder configured to decompress the second half frame image data read from the second half frame memory region to output the second full frame image data of the previous frame.

In an 'enhance starting' mode, the control unit compresses full frame image data of the current frame to half frame image data to store the half frame image data in the first and second half frame memory regions, respectively, reads the half frame image data from the first half frame memory region, and decompresses the read half frame image data to the full frame image data to output the full frame image data. In an 'enhance ending' mode, the control unit reads the half frame image data from the first half frame memory region, and decompresses the read half frame image data to the full frame image data to output the full frame image data.

The mode determination unit may include a first counter configured to periodically count the number of frames up to M frames based on a vertical synchronization signal, where M is a positive integer, a second counter configured to periodically count the number of memory write commands during the M frames, and a signal generator configured to generate a mode signal indicating the normal mode when the number of memory write commands is less than a reference number and indicating the enhance mode when the number of memory write commands is equal to or greater than the reference number.

The second counter may be reset in response to a tearing effect control signal while the first counter outputs a counted number of M.

Another aspect of the invention provides a method of operating an image processing circuit including a full frame memory, the method comprising. The image processing circuit may be a display drive integrated (DDI) circuit and the method may include a method of autonomously selecting an operating mode of the image processing circuit. The method may comprise receiving periodic vertical synchronization (VSYNC) signals having a VSYNC period;

receiving frames of image data of a first type in a first time period;

receiving frames of image data of a second type in a second time period;

repeatedly counting the number of periodic vertical synchronization signals up to M, where M is a positive integer;

repeatedly counting the number of frames of image data received within each time period (VSYNC period times M) of the counted M vertical synchronization signals;

continuously determining whether the currently-received frames of image data are of the first type or of the second type, based on the counted number of frames of image data; and controlling the image processing circuit to operate in a first mode if the currently-received frames of image data are determined to be of the first type and to operate in a second mode if the currently-received received frames of image data are determined to be of the second type.

The first type may be still-image and the second type may be video. The first mode may be a 'normal' display mode and the second mode may be an 'enhance' display mode, While operating in the 'normal' display mode, the received image data is stored non-compressed full frame in the full frame memory. While operating in the 'enhance' display mode, the method further comprises: compressing image data of a first frame of the received image data; compressing the image data of a second frame of the received image data; and the single full frame memory is functionally divided into a first half frame memory region and a second half frame memory region and compressing and storing image data of the first frame of the received image data in the first half frame memory region and compressing and storing image data of the second frame of the received image data in the second half frame memory region.

In exemplary embodiments wherein the image processing circuit is a display drive integrated (DDI) circuit, the method may further comprise: reading and decompressing the compressed image data stored in the first half frame memory region to output full frame image data to a display; and reading and decompressing the compressed image data stored in the second half frame memory region to output full frame image data to the display.

Various exemplary embodiments will be described more fully hereinafter with reference to the accompanying drawings, in which some exemplary embodiments are shown. The present inventive concept may, however, be embodied in many different forms and should not be construed as limited to the exemplary embodiments set forth herein. Rather, these exemplary embodiments are provided so that this disclosure will be thorough and complete, and will fully convey the scope of the present inventive concept to those skilled in the art. In the drawings, the sizes and relative sizes of layers and regions may be exaggerated for clarity. Like numerals refer to like elements throughout.

It will be understood that, although the terms first, second, third etc. may be used herein to describe various elements, these elements should not be limited by these terms. These terms are used to distinguish one element from another. Thus, a first element discussed below could be termed a second element without departing from the teachings of the present inventive concept. As used herein, the term "and/or" includes any and all combinations of one or more of the associated listed items.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular exemplary embodiments only and is not intended to be limiting of the present inventive concept. As used herein, the singular forms "a," "an" and "the" are intended to include the plural forms as well, unless the context clearly indicates otherwise.

It should also be noted that in some alternative implementations, the functions/acts noted in the blocks may occur out of the order noted in the flowcharts. For example, two blocks shown in succession may in fact be executed substantially concurrently or the blocks may sometimes be executed in the reverse order, depending upon the functionality/acts involved.

Unless otherwise defined, all terms (including technical and scientific terms) used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

BRIEF DESCRIPTION OF THE DRAWINGS

Illustrative, non-limiting exemplary embodiments will be more clearly understood from the following detailed description taken in conjunction with the accompanying drawings, in which.

DETAILED DESCRIPTION OF THE EXEMPLARY EMBODIMENTS

Figure 1:
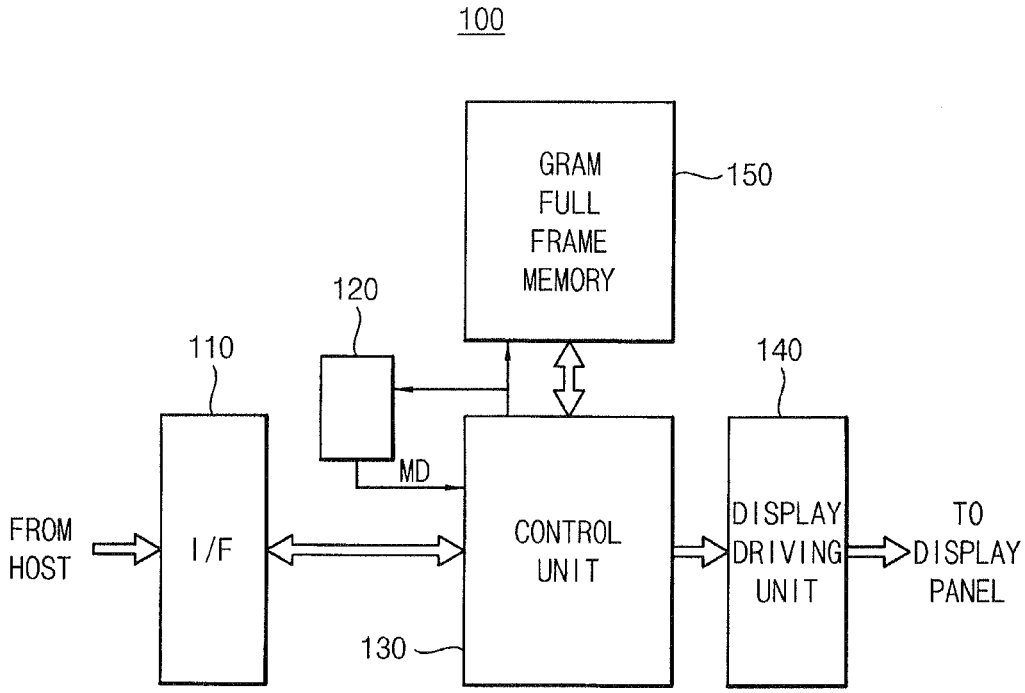
FIG. 1 is a block diagram of a display drive integrated circuit (DDI) according to an exemplary embodiment.

FIG. 1 is a block diagram of a display drive integrated circuit (DDI) according to an exemplary embodiment.

Referring to FIG. 1, the DDI 100 includes an interface unit (I/F) 110, a mode determination unit 120, a control unit 130, a display driving unit 140 and a memory 150.

The interface unit 110 receives image data and control signals provided from a host and outputs DDI status signals to the host. The interface unit 110 may include a central processing unit (CPU) interface, a color image data (RGB) interface, a serial peripheral interface (SPI), a mobile display digital interface (MDDI), etc.

The mode determination unit 120 determines or selects operation modes associated with the display quality, including a normal mode and an enhance mode. The mode determination unit 120 generates a mode signal MD selecting the normal mode or the enhance mode. The disclosed display quality enhancing process is not performed while the mode signal MD indicates the 'normal' mode and is performed when the mode signal MD indicates the 'enhance' mode. In some exemplary embodiments, the mode determination unit 120 measures the update speed of image data to be stored in memory 150 to determine/select the operation mode. The mode determination unit 120 may be referred to as an 'update speed measurement unit'.

The control unit 130 controls the memory 150 to store image data and process the image data to provide display data to the display driving unit 140. The control unit 130 may operate in the normal mode or the enhance mode in response to the mode signal MD output from the mode determination unit 120.

The display driving unit 140 receives the display data from the control unit to drive data lines or source lines of a display panel such as a liquid crystal display (LCD) panel, an organic light-emitting diode (OLED) panel, etc.

The memory 150 may be a graphic random access memory (GRAM) having a storage capacity of image data corresponding to a single full frame, and thus the memory 150 may be referred to as a full frame memory.

As will be described below, the DDI 100 can perform display quality enhancing process using the single full frame memory 150, without an additional memory dedicated to the display quality enhancing process. Thus the DDI 100 according to exemplary embodiments may have reduced chip size and reduced power consumption to be more suitable for a mobile device.

Figure 2A:
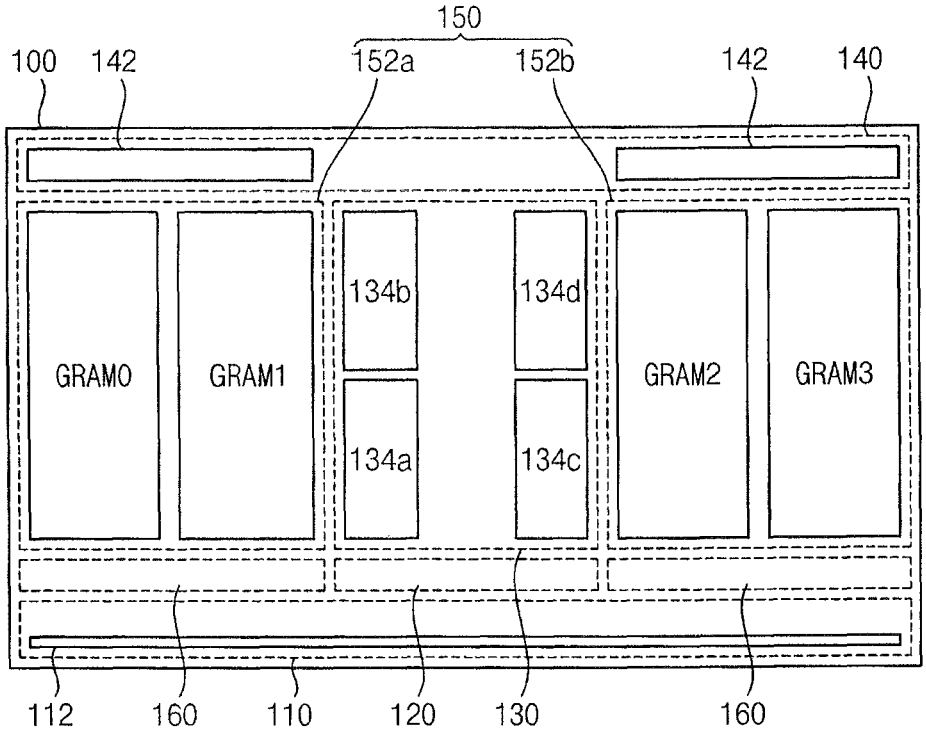
FIG. 2A is a diagram illustrating an exemplary layout of a DDI according to exemplary embodiments.
Figure 2B:
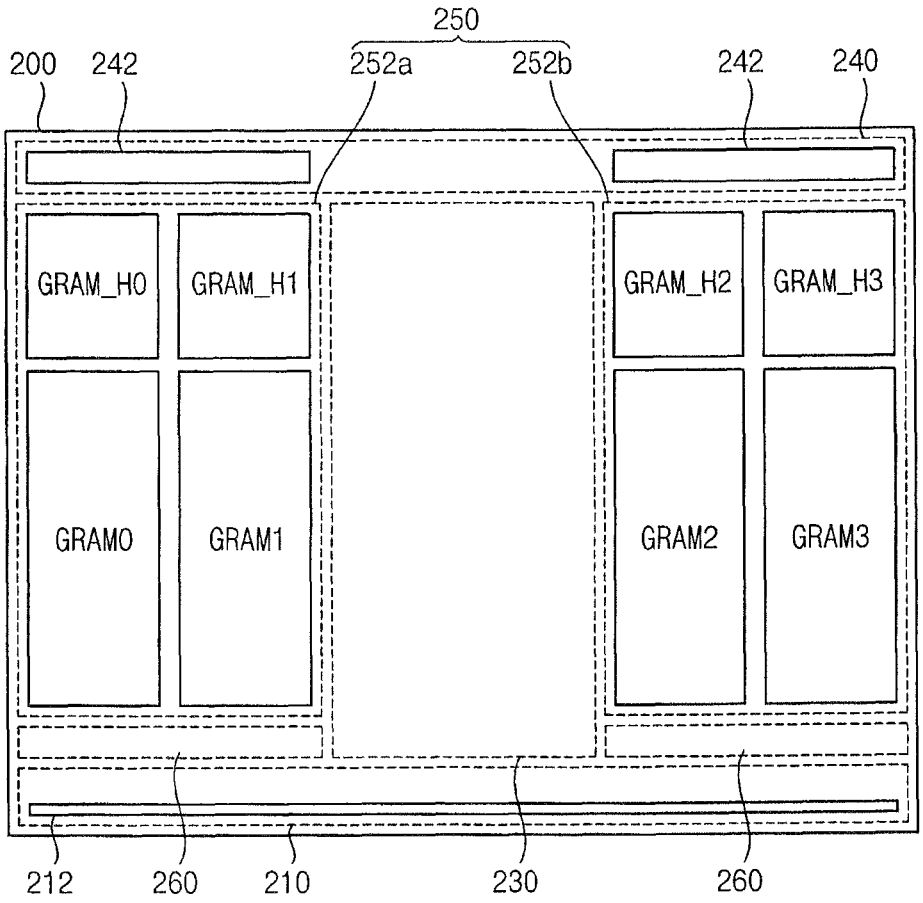
FIG. 2B is a diagram illustrating an example layout of a DDI including additional memories.

FIG. 2A is a diagram illustrating an exemplary layout of a DDI according to exemplary embodiments, and FIG. 2B is a diagram illustrating an exemplary layout of a DDI including additional memories.

Referring to FIG. 2A, a control unit region 130 may be disposed at a central portion of a DDI chip 100, a memory region 150 may be disposed at both side portions, a display driving unit region 140 may be disposed at an upper portion and an interface unit region 110 may be disposed at a bottom portion. A mode determination unit region 120 may be disposed between the control unit region 130 and the interface unit region 110, and a power region 160 may be disposed between the memory region 150 and the interface unit region 110.

The display driving unit region 140 may include a source channel block 142 coupled to the source lines of the display panel (not shown). The interface unit region 110 may include an input pad block 112.

The memory region 150 may include a plurality (e.g., four) of memory blocks GRAM0 through GRAM3. The total storage capacity of the four memory blocks GRAM0 through GRAM3 may correspond to a single full frame of image data. The memory region 150 may be divided into a first half frame memory region 152*a* including the memory blocks GRAM0 and GRAM1 (shown at the left side of the control unit region 130) and a second half frame memory region 152*b* including the memory blocks GRAM2 and GRAM3 (shown at the right side of the control unit region 130).

In the 'normal' mode, the control unit 130 stores non-compressed full frame image data in the entire single full frame memory 150. In the 'enhance' mode, the control unit region 130 divides and differently controls the single full frame memory 150 into the first half frame memory region 152*a* and the second half frame memory region 152*b*. For example, the control unit 130 stores compressed image data of a current frame in the first half frame memory region 152*a* and stores compressed image data of a previous frame in the second half frame memory region 152*b*.

The control unit region 130 includes a first encoder 134*a*, a first decoder 134*b*, a second encoder 134*c* and a second decoder 134*d*. The first encoder 134*a* compresses first full frame image data of the current frame to output first half frame image data to be stored in the first half frame memory region 152*a*. The first decoder 134*b* decompresses the first half frame image data read from the first half frame memory region 152*a* to output the first full frame image data of the current frame. The second encoder 134*c* compresses second full frame image data of the previous frame to output second half frame image data to be stored in the second half frame memory region 152*b*. The second decoder 134*d* decompresses the second half frame image data read from the second half frame memory region 152*b* to output the second full frame image data of the previous frame.

Referring to FIG. 2B, memory region 250 of the DDI chip 200 further includes (as compared with the layout of FIG. 2A) half frame memory GRAM_H1 through GRAM_H3 in addition to the full frame memory GRAM0 through GRAM3 mpared with the layout of FIG. Even though the DDI chip 200 may omit some of the encoders 134*a* and 134*c* and the decoders 134*b* and 13*d* present in the DDI chip 100 of FIG. 2A, the chip area of the encoders and the decoders is relatively small and the additional memory GRAM_H1 through GRAM_H3 causes a significant increase of chip size. Accordingly, the size of the DDI chip 100 of FIG. 2A according to exemplary embodiments may be decreased as compared with the DDI chip 200 of FIG. 2B which includes the addition of half frame memory GRAM_H1 through GRAM_H3.

Figure 3:
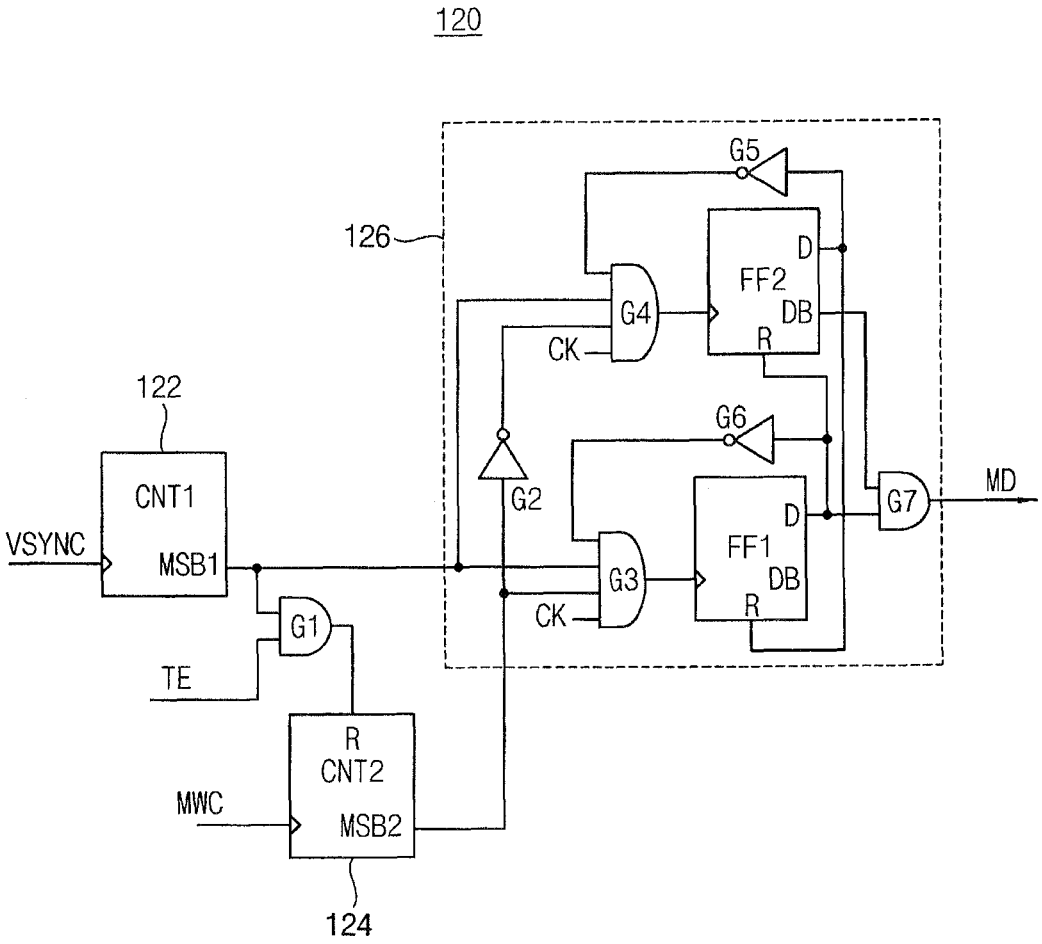
FIG. 3 is a circuit diagram illustrating exemplary implementation of the mode determination unit of FIG. 1.
Figure 4:
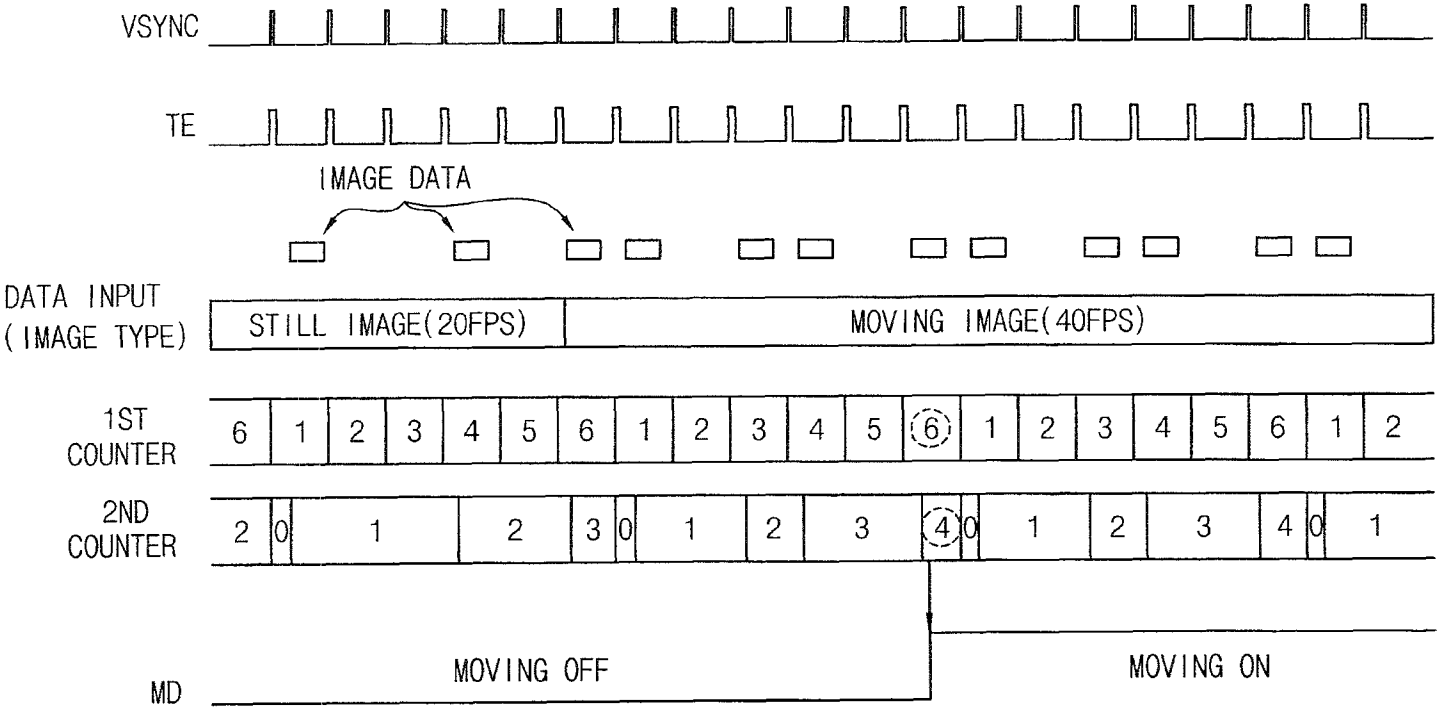
FIG. 4 is a timing diagram for describing a transition from a normal mode to an enhance mode.
Figure 5:
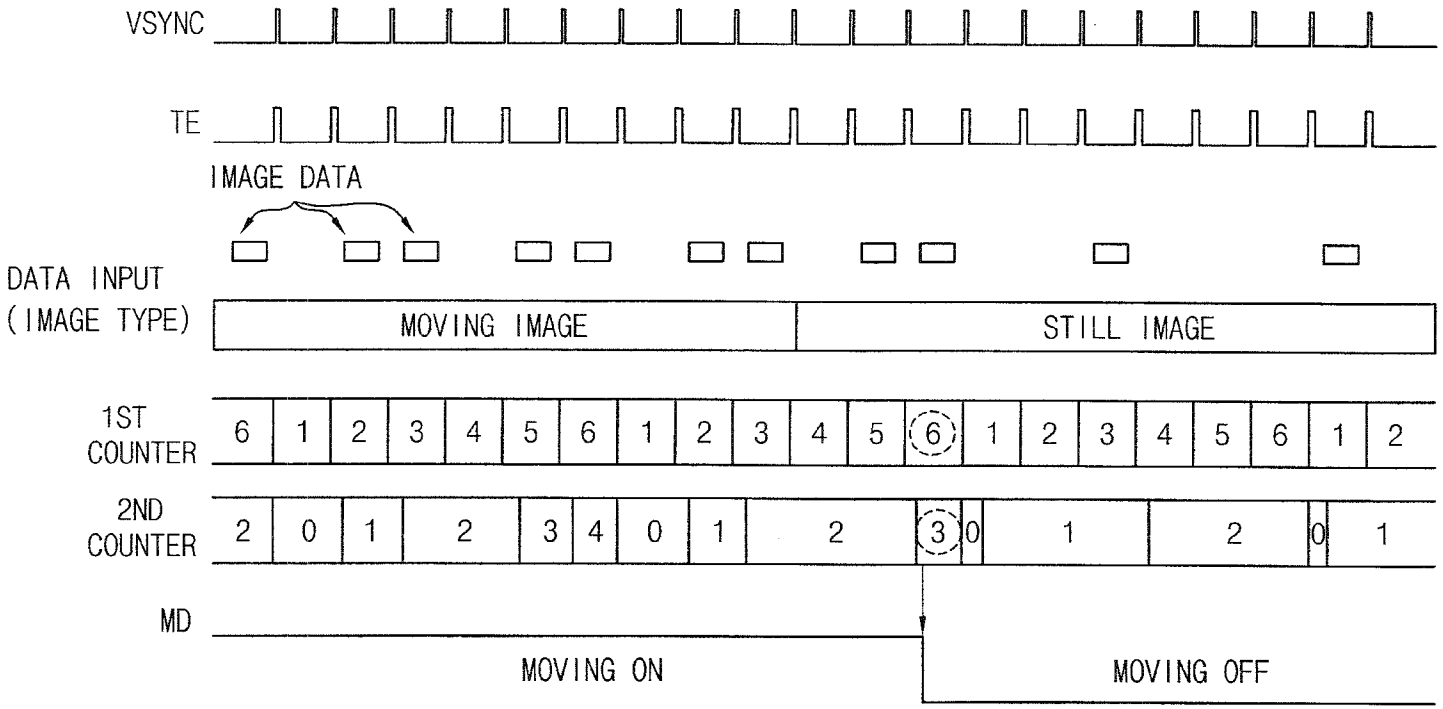
FIG. 5 is a timing diagram for describing a transition from the enhance mode to the normal mode.

FIG. 3 is a circuit diagram of an exemplary implementation of the mode determination unit 120 of FIG. 1. FIG. 4 is a timing diagram for describing the transition from a normal mode to an enhance mode and FIG. 5 is a timing diagram for describing a transition from the enhance mode to the normal mode.

Referring to FIG. 3, a mode determination circuit 120 includes a first counter 122, a second counter 124 and a signal generator 126. The mode determination unit 120 determines whether the currently-displayed image is a still image or a moving image by measuring the update speed of image data to be stored in the full frame memory. Accordingly even though explicit information associated with the display quality mode may not be provided from the host, the DDI including the mode determination unit 120 may autonomously determine the display quality mode among the normal mode and the enhance mode by determining whether the currently-displayed image is a still image or a moving image.

The first counter (CNT1) 122 may be configured to periodically count the number of frames by M frames based on a vertical synchronization signal VSYNC, where M is a positive integer. In other words, the first counter 122 is reset at every M-th pulse of the vertical synchronization signal VSYNC to repeatedly count the frame number from one to M. Thus the most significant bit MSB 1 of the first counter 122 may have a logic high value periodically at every M-th pulse of the vertical synchronization signal VSYNC.

The second counter (CNT2) 124 may be configured to periodically count the number of memory write commands MWC during the M frames. The second counter 124 may be configured to periodically count the number of the memory write commands MWC by N, where N is a reference number. The second counter may be reset in response to an output of an AND gate G1 that performs an AND operation on a tearing effect control signal TE and the most significant bit MSB1 of the first counter 122.

For example, assume the frame periodical number M is six and the reference number N is four as described with reference to FIGS. 4 and 5. In this case, the most significant bit MSB2 of the second counter 124 will have a logic high value if the number of the memory write commands MWC during the six frames is equal to or greater than the reference number N of four, and thus the update speed of the image data may be determined as corresponding to the moving image. In contrast, the most significant bit MSB2 of the second counter 124 will have a logic high value if the number of the memory write commands MWC during the six frames is less than the reference number N of four, and thus the update speed of the image data may be determined as corresponding to the still image.

The tearing effect control signal TE may have a predetermined pulse cycle period and a predetermined pulse width for preventing the tearing effect well known to persons in the art. By synchronizing the reset timing of the second counter 124 to the tearing effect control signal TE, the mode transition timing from the normal mode to the enhance mode or vise versa may be controlled to prevent the tearing effect. In some exemplary embodiments, the AND gate G1 may be omitted and the most significant bit MSB1 of the first counter 122 may be directly applied to the reset terminal R of the second counter 124.

The signal generator 126 may be configured to generate a mode signal MD indicating the normal mode or the still image mode when the number of memory write commands MWC during the M frames is less than the reference number N and the enhance mode when the number of memory write commands MWC during the M frames is equal to or greater than the reference number N.

The signal generator 126 includes AND gates G3, G4 and G7, inverters G2, G5 and G6, a first flip-flop FF1 and a second flip-flop FF2.

Referring FIGS. 3 and 4, when the number of memory write commands MWC during the period of six frames is equal to or greater than the reference number N (e.g., N=four), both of the most significant bits MSB1 and MSB2 of the counters 122 and 124 have the logic high value. In this case, the gate G3 is enabled (outputting logic high) in synchronization with an edge of a clock signal CK to output the logic high value through a positive output terminal D and the first flip-flop FF1 latches and outputs the logic high value. The inverter G6 inverts the output of the AND gate G3, and the logic low value from inverter G6 is fed back as one input of the AND gate G3 with some loop delay. When the logic low value from inverter G6 is fed back, the AND gate G3 is disabled but the positive output terminal D of the first flip-flop FF1 maintains the logic high value. Thus, the transition from the normal mode (the still image mode) to the enhance mode (the moving image mode) may be detected.

Referring FIGS. 3 and 5, when the number of memory write commands MWC during the six frames is less than the reference number N (N=four), the most significant bit MSB2 of the second counter 124 has the logic low value while the most significant bit MSB1 of the first counter 122 has the logic high value. In this case, the gate G4 receiving the logic high level through the inverter G2 is enabled in synchronization with an edge of the clock signal CK, and the second flip-flop FF2 latches the logic high value to output the logic high value through a positive output terminal D and the logic low value through a negative output terminal DB. The inverter G5 inverts the output of the AND gate G4, and the logic low value is fed back as one input of the AND gate G4. When the logic low value from inverter G56 is fed back, the AND gate G4 is disabled and the positive output terminal D of the second flip-flop FF2 maintains the logic high value. As such, the transition from the enhance mode or the moving image mode to the normal mode or the still image mode may be detected.

The output of the positive output terminal D of the second flip-flop FF2 is applied to the reset terminal R of the first flip-flop FF1. When the output of the positive output terminal D of the second flip-flop FF2 transitions to the logic high level from the logic low level, the first flip-flop FF1 is reset and the output of the positive output terminal D of the first flip-flop FF1 is reset to the logic low value.

In the same way, the output of the positive output terminal D of the first flip-flop FF1 is applied to the reset terminal R of the second flip-flop FF2. When the output of the positive output terminal D of the first flip-flop FF1 transitions to the logic high level from the logic low level, the second flip-flop FF1 is reset and the output of the positive output terminal D of the second flip-flop FF2 is reset to the logic low value.

As such, the outputs of the positive output terminals D of the first and second flip-flops FF1 and FF2 may thusly be reset to have the complementary logic levels. In other words, the output of the negative output terminal DB of the second flip-flop FF2 will have the same logic value as the output of the positive output terminal D of the first flip-flop FF1. The AND gate G7 performs an AND operation on the output of the positive output terminal D of the first flip-flop FF1 and the output of the negative output terminal DB of the second flip-flop FF2 to output the mode signal MD. Accordingly the mode determination circuit 120 outputs the mode signal MD indicating the normal mode or the still image mode when the number of memory write commands MWC during the M frames is less than the reference number N and outputs the mode signal MD indicating the enhance mode when the number of memory write commands MWC during the M frames is equal to or greater than the reference number N.

Figure 6:
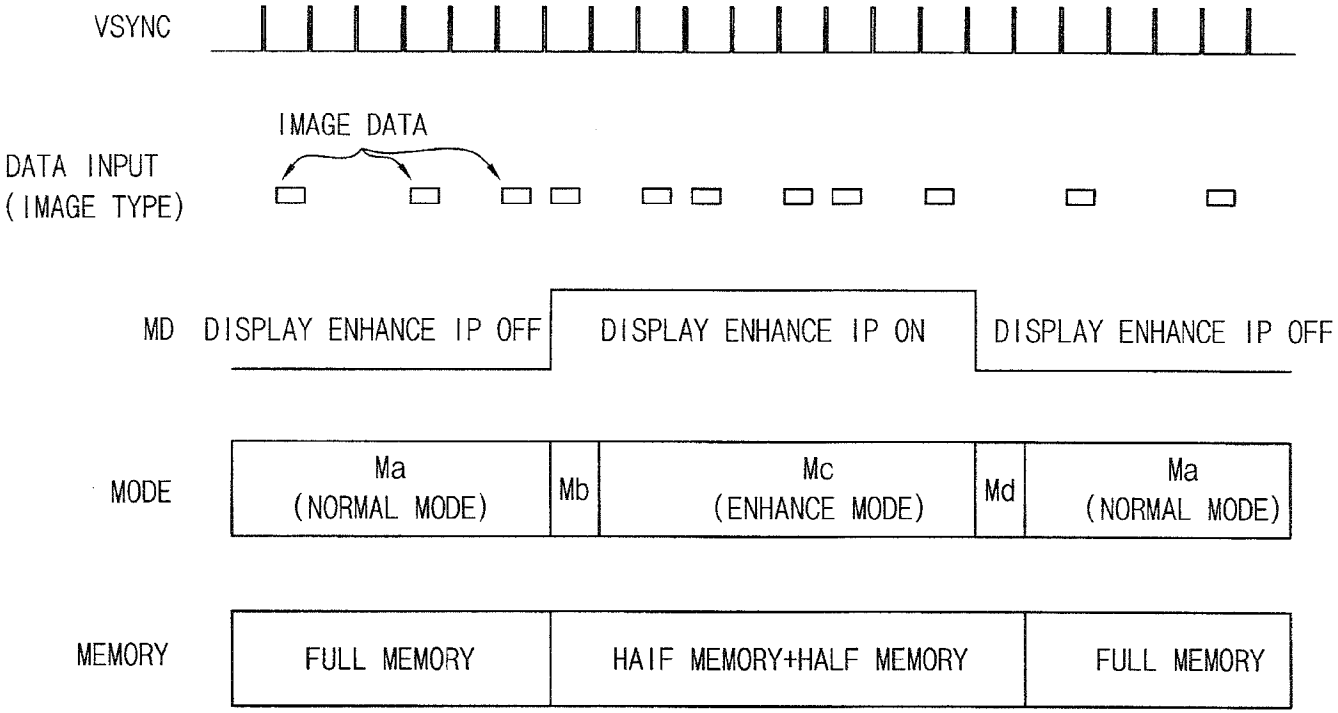
FIG. 6 is a timing diagram for describing the overall operation of a DDI according to exemplary embodiments.

FIG. 6 is a timing diagram for describing the overall operation of a DDI according to exemplary embodiments.

Referring to FIG. 6, the control unit 130 of FIG. 1 may operate in the normal mode Ma when the mode signal MD is deactivated in the logic low level and in the enhance mode Mc when the mode signal MD is activated in the logic high level. Thus, a display enhance intellectual property (IP) included in the control unit 130 may be turned off in the normal mode Ma and turned on in the enhance mode Mc. The memory 150 of FIG. 1 may operate as the single full frame memory GRAM0 through GRAM3 in the normal mode Ma and may be divided into the two half frame memories, i.e., the first half frame memory GRAM0 and GRAM1 and the second half frame memory GRAM2 and GRAM3, as described with reference to FIG. 2A.

In some exemplary embodiments, the control unit 130 may be further configured to operate in an 'enhance starting' mode Mb corresponding to a transition from the normal mode Ma to the enhance mode Mc and an 'enhance ending' mode Md corresponding to a transition from the enhance mode Mc to the normal mode Ma.

FIGS. 7 through 10 are conceptual diagrams describing data flows corresponding to respective operation modes ('normal' mode Ma, 'enhance starting' mode Mb, 'enhance' mode Mc, and 'enhance ending' mode Md) of a DDI according to exemplary embodiments.

Figure 7:
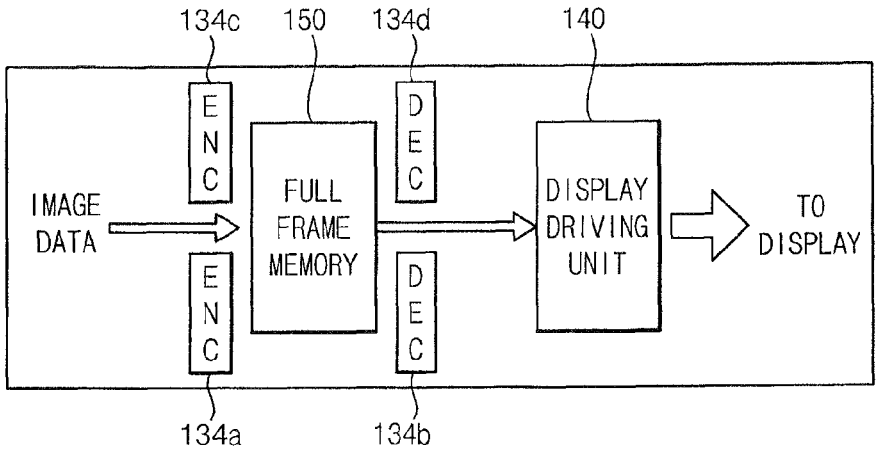
FIGS. 7 through 10 are conceptual diagrams describing data flows corresponding to respective operation modes of a DDI according to exemplary embodiments.

Referring to FIG. 7, in the 'normal' mode Ma, the control unit 130 stores non-compressed full frame image data in the single full frame memory 150 and the encoders 134*a* and 134*c* and the decoders 134*b* and 134*d* in the control unit 130 are disabled since compression and decompression of the image data are not required. The control unit 130 reads the non-compressed full frame image data from the single full frame memory 150 to provide the non-compressed full frame image data to the display driving unit 140 as the display image data without performing a display quality enhancing process.

Figure 8:
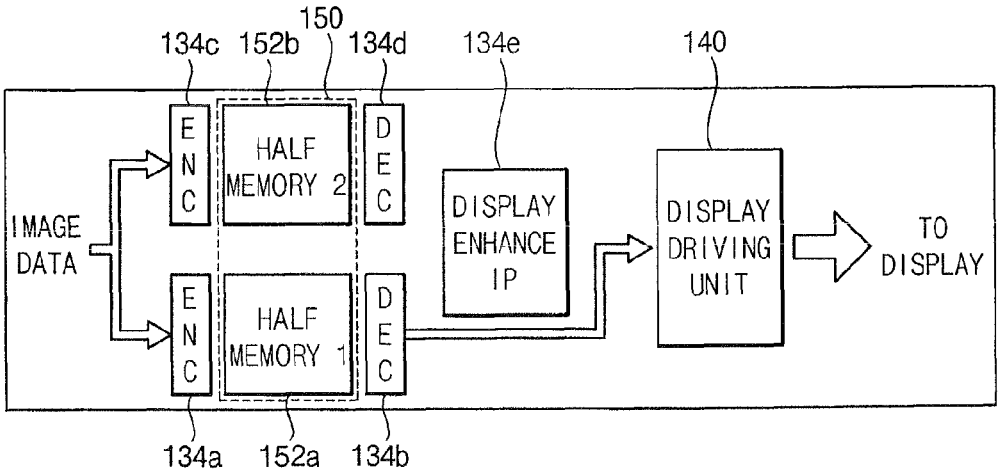

Referring to FIG. 8, in the 'enhance starting' mode Mb, the control unit 130 provides the input image data to the first and second encoders 134*a* and 134*c*. The first and second encoders 134*a* and 134*c* compress full frame image data of the current frame to half frame image data to store the half frame image data in the first and second half frame memory regions 152*a* and 152*b*, respectively. The half frame image data is read from the first half frame memory region 152*a*, and the first decoder 134*b* decompresses the read half frame image data to the full frame image data to provide the full frame image data to the display driving unit 140 as the display image data. In this 'enhance starting' mode Mb, the display enhance IP circuit 134*e* in the control unit 130 does not perform the display quality enhancing process.

Figure 9:
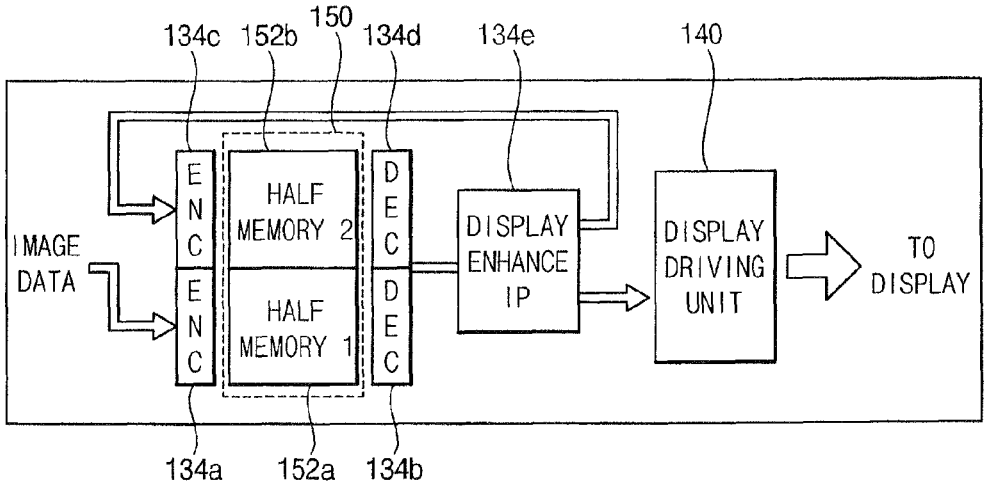

Referring to FIG. 9, in the 'enhance' mode Mc, the control unit 130 provides the input image data to the first encoder 134*a*. The first encoder 134*a* compresses the full frame image data of the current frame to half image data to store the compressed image data of the current frame in the first half frame memory region 152*a*. The display enhance IP 134*e* in the control unit 130 provides enhanced image data to the second encoder 134*c*. The second encoder 134*c* compresses the full frame image data of the previous frame to half image data to store the compressed image data of the previous frame in the second half frame memory region 152*b*. The first half frame image data of the current frame is read from the first half frame memory region and the second half frame image data of the previous frame is read from the second half frame memory region to be decompressed to the full frame data by the first and second decoders 134*b* and 134*d*, respectively. The display enhance IP 134*e* performs the display quality enhancing process based on the decompressed full frame data of the current frame and the previous frame to output the enhanced image data to the display driving unit 140 as the display image data. As described above, the second encoder 134*c* compresses the enhanced image data to half frame image data to store the compressed half frame image data, as the previous frame data for the next process, in the second half frame memory region 152*b*.

Figure 10:
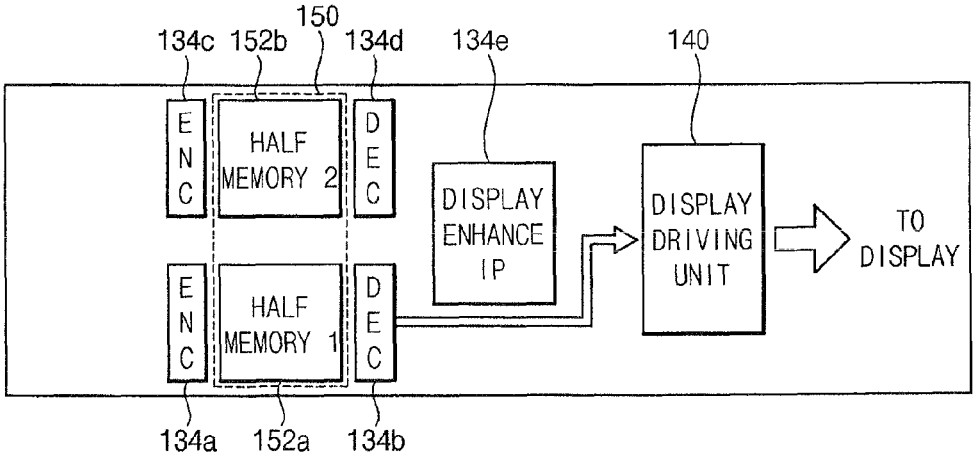

Referring to FIG. 10, in the 'enhance ending' mode Md, the control unit 130 reads the half frame image data from the first half frame memory region 152*a*, and the first decoder 134*b* decompresses the read half frame image data to the full frame image data to output the fall frame image data to the display driving unit 140 as the display image data. In this 'enhance ending' mode, the display enhance IP circuit 134*e* in the control unit 130 does not perform the display quality enhancing process.

Figure 11:
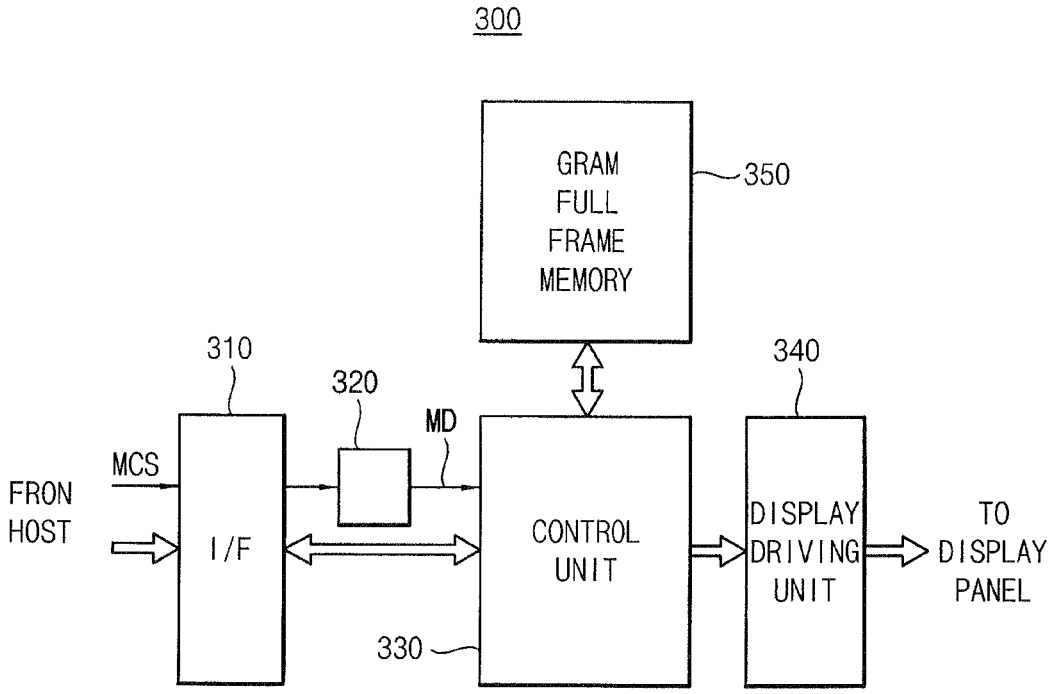
FIG. 11 is a block diagram of a DDI according to exemplary embodiments.

FIG. 11 is a block diagram of a DDI according to exemplary embodiments.

Referring to FIG. 11, the DDI 300 includes an interface unit (I/F) 310, a mode determination unit 320, a control unit 330, a display driving unit 340 and a memory 350. The configurations and the operations of the DDI 300 except for the mode determination unit 320 are the same or similar to those of the DDI 100 of FIG. 1 and thus the redundant descriptions thereof are omitted.

The mode determination unit 320 of FIG. 11 may determine the normal mode or the enhance mode based on a mode control signal MCS from an external host. For example, the mode determination unit 320 may determine based on the mode control signal MCS whether the currently-provided image data correspond to still image data or moving image data. The mode determination unit 320 may generate the mode signal MD indicating the normal mode when the currently-provided image data correspond to still image data and generate the enhance mode when the currently-provided image data correspond to moving image data. The mode determination unit 320 may be implemented with registers, flip-flops, latches, and/or logic gates. Since the mode determination unit 320 selects the display quality mode based on the mode control signal MCS from the host, the mode determination unit 320 may have a simpler configuration than the mode determination unit 120 illustrated in FIG. 3.

The control unit 330 operates in the selected one of the 'normal' mode or the 'enhance' mode in response to the mode signal MD output from the mode determination unit 320. When the mode signal MD indicates the normal mode (the still image display mode), the control unit 330 stores non-compressed full frame image data in the single full frame memory 350. When the mode signal MD indicates the enhance mode (the moving image display mode), the control unit 330 divides the single full frame memory 350 into a first half frame memory region and a second half frame memory region to store compressed image data of a current frame in the first half frame memory region and compressed image data of a previous frame in the second half frame memory region.

Each block or the assembly of the blocks in FIG. 11 may be embodied variously in forms of software, hardware or a combination of software and hardware. To realize the operations and functions of each block or the assembly of the blocks, at least a portion of the DDI may include a general purpose processor (GPP), a special purpose processor (SPP), etc., which may perform software-based operations.

Features and/or embodiments described herein may be applied to any photo-detection device, such as a three-dimensional image sensor providing image information and depth information about an object. For example, one or more exemplary embodiments may be applied to a computing system, such as a face recognition security system, a desktop computer, a laptop computer, a digital camera, a three-dimensional camera, a video camcorder, a cellular phone, a smart phone, a personal digital assistant (PDA), a scanner, a video phone, a digital television, a navigation system, an observation system, an auto-focus system, a tracking system, a motion capture system, an image-stabilizing system, etc.

The foregoing is illustrative of exemplary embodiments and is not to be construed as limiting thereof. Although a few exemplary embodiments have been described, those skilled in the art will readily appreciate that many modifications are possible in the exemplary embodiments without materially departing from the novel teachings of the present inventive concepts. Accordingly, all such modifications are intended to be included within the scope of the present inventive concepts as defined in the claims. Therefore, it is to be understood that the foregoing is illustrative of various exemplary embodiments and is not to be construed as limited to the specific exemplary embodiments disclosed, and that modifications to the disclosed exemplary embodiments, as well as other exemplary embodiments, are intended to be included within the scope of the appended claims.

What is claimed is:

1. A display drive integrated circuit (DDI) comprising:

a first full frame memory having a first half frame memory region and a second half frame memory region;

a control unit configured to:

operate in a normal mode in response to a first value of a mode signal;

while operating in the normal mode, store non-compressed full frame image data of the current frame in the first full frame memory;

operate in an enhance mode in response to second value of a mode signal; and while operating in the enhance mode, store compressed image data of the current frame in the first half frame memory region and store compressed image data of a previous frame in the second half frame memory region.

2. The DDI of claim 1, wherein the control unit includes:

a first encoder configured to compress first full frame image data of the current frame to output first half frame image data to be stored in the first half frame memory region;

a first decoder configured to decompress the first half frame image data read from the first half frame memory region to output the first full frame image data of the current frame;

a second encoder configured to compress second full frame image data of the previous frame to output second half frame image data to be stored in the second half frame memory region; and a second decoder configured to decompress the second half frame image data read from the second half frame memory region to output the second full frame image data of the previous frame.

3. The DDI of claim 1, wherein the control unit is configured to:

while operating in the normal mode, read the non-compressed full frame image data from the first full frame memory to output the non-compressed full frame image data without performing a display quality enhancing process; and while operating in the enhance mode, read first half frame image data from the first half frame memory region and second half frame image data from the second half frame memory region, perform the display quality enhancing process based on the first and second half frame image data to output enhanced image data, and compress the enhanced image data to third half frame image data to store the third half frame image data in the second half frame memory region.

4. The DDI of claim 1, wherein the control unit is configured to;

while operating in an enhance starting mode, compress full frame image data of the current frame to half frame image data to store the half frame image data in the first and second half frame memory regions, respectively, read the half frame image data from the first half frame memory region, and decompress the read half frame image data to the full frame image data to output the full frame image data; and while operating in an enhance ending mode, read the half frame image data from the first half frame memory region, and decompress the read half frame image data to the full frame image data to output the full frame image data.

5. The DDI of claim 1, further comprising:

a mode determination unit configured to select one of the normal mode or the enhance mode associated with a display quality and to output the mode signal according to the selection, wherein the mode determination unit includes:

a first counter configured to periodically count the number of frames up to M frames based on a vertical synchronization signal, where M is a positive integer;

a second counter configured to periodically count the number of memory write commands during the M counted frames; and a signal generator configured to generate the mode signal indicating the normal mode if the number of memory write commands during the M frames is less than a reference number and indicating the enhance mode if the number of memory write commands during the M frames is equal to or greater than the reference number.

6. The DDI of claim 5, wherein the second counter is configured to be reset in response to a tearing effect control signal while the first counter outputs the number M.

7. The DDI of claim 5, wherein M is six and the reference number is four.

8. The DDI of claim 1, further comprising:

a mode determination unit configured to select one of the normal mode or the enhance mode associated with a display quality and to output the mode signal according to the selection, wherein the mode determination unit is configured to select the normal mode or the enhance mode based on a mode control signal from an external host.

9. The DDI of claim 1, wherein the mode determination unit is configured to measure the update speed of image data to be stored in the full frame memory and configured to generate a mode signal indicating the normal mode if the update speed corresponds to a still image speed and the enhance mode if the update speed corresponds to a moving image speed.

10. A display drive integrated circuit (DDI) comprising:

a single full frame memory having a first half frame memory region and a second half frame memory region;

a mode determination unit configured to determine a normal mode or an enhance mode associated with a display quality by measuring a update speed of received image data; and a control unit configured to operate in the normal mode or the enhance mode in response to an output of the mode determination unit and configured to store the received image data in both the first half frame memory region and the second half frame memory region separately in the normal mode;

and configured to operate the first half frame memory region and the second half frame memory region separately in the enhance mode.

11. The DDI of claim 10, wherein the control unit is configured to while operating in the normal mode, store non-compressed full frame image data in the single full frame memory and read the non-compressed full frame image data from the single full frame memory to output the non-compressed full frame image data as still image display data without performing a display quality enhancing process; and while operating in the enhance mode, store compressed image data of a current frame in the first half frame memory region and compressed image data of a previous frame in the second half frame memory region, read first half frame image data from the first half frame memory region and second half frame image data from the second half frame memory region, perform the display quality enhancing process based on the first and second half frame image data to output enhanced image data as moving image display data, and compress the enhanced image data to third half frame image data to store the third half frame image data in the second half frame memory region.

12. The DDI of claim 11, wherein the control unit includes:

a first encoder configured to compress first full frame image data of the current frame to output first half frame image data to be stored in the first half frame memory region;

a first decoder configured to decompress the first half frame image data read from the first half frame memory region to output the first full frame image data of the current frame;

a second encoder configured to compress second full frame image data of the previous frame to output second half frame image data to be stored in the second half frame memory region; and a second decoder configured to decompress the second half frame image data read from the second half frame memory region to output the second full frame image data of the previous frame.

13. The DDI of claim 11, wherein the control unit is configured to;

while operating in an enhance starting mode, compress full frame image data of the current frame to half frame image data to store the half frame image data in the first and second half frame memory regions, respectively, read the half frame image data from the first half frame memory region, and decompress the read half frame image data to the full frame image data to output the full frame image data; and while operating in an enhance ending mode, read the half frame image data from the first half frame memory region, and decompress the read half frame image data to the full frame image data to output the full frame image data.

14. The DDI of claim 11, wherein the mode determination unit includes:

a first counter configured to periodically count the number of frames up to M frames based on a vertical synchronization signal, where M is a positive integer;

a second counter configured to periodically count the number of memory write commands during the M frames; and a signal generator configured to generate a mode signal indicating the normal mode when the number of memory write commands is less than a reference number and to generate a mode signal indicating the enhance mode when the number of memory write commands is equal to or greater than the reference number.

15. The DDI of claim 14, wherein the second counter is configured to be reset in response to a tearing effect control signal while the first counter outputs a counted number of M.

16. A method of operating an image processing circuit including a full frame memory, the method comprising:

receiving periodic vertical synchronization (VSYNC) signals having a VSYNC period;

receiving frames of image data of a first type in a first time period;

receiving frames of image data of a second type in a second time period;

repeatedly counting the number of periodic vertical synchronization signals up to M, where M is a positive integer;

repeatedly counting the number of frames of image data received within each time period (VSYNC period times M) of the counted M vertical synchronization signals;

continuously determining whether the currently-received frames of image data are of the first type or of the second type, based on the counted number of frames of image data; and controlling the image processing circuit to operate in a first mode if the currently-received frames of image data are determined to be of the first type and to operate in a second mode if the currently-received received frames of image data are determined to be of the second type.

17. The method of claim 16, wherein the first type is still-image and the second type is video.

18. The method of claim 17, wherein the first mode is a 'normal' display mode and the second mode is an 'enhance' display mode, wherein while operating in the 'normal' display mode, the received image data is stored non-compressed full frame in the full frame memory, and further comprising, while operating in the 'enhance' display mode:

compressing image data of a first frame of the received image data;

compressing the image data of a second frame of the received image data; and the single full frame memory is functionally divided into a first half frame memory region and a second half frame memory region and compressing and storing image data of the first frame of the received image data in the first half frame memory region and compressing and storing image data of the second frame of the received image data in the second half frame memory region.

19. The method of claim 18, wherein the image processing circuit is a display drive integrated (DDI) circuit.

20. The method of claim 19, further comprising:

reading and decompressing the compressed image data stored in the first half frame memory region to output full frame image data to a display; and reading and decompressing the compressed image data stored in the second half frame memory region to output full frame image data to the display.

* * * * *